US007100122B2

(12) United States Patent
Blaschke et al.

(10) Patent No.: US 7,100,122 B2
(45) Date of Patent: Aug. 29, 2006

(54) LIMITING UNSOLICITED BROWSER WINDOWS

(75) Inventors: David Earl Blaschke, Austin, TX (US); Scott Thomas Jones, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 600 days.

(21) Appl. No.: 10/185,555

(22) Filed: Jun. 27, 2002

(65) Prior Publication Data

US 2004/0001102 A1 Jan. 1, 2004

(51) Int. Cl.
*G09G 5/00* (2006.01)

(52) U.S. Cl. ..... 715/808; 715/804; 715/781; 715/760; 715/783; 715/789; 715/854

(58) Field of Classification Search ..... 715/760, 715/808, 789, 783, 804, 854, 781
See application file for complete search history.

(56) References Cited

U.S. PATENT DOCUMENTS

| | | | | |
|---|---|---|---|---|
| 4,769,636 | A * | 9/1988 | Iwami et al. | 715/790 |
| 6,025,841 | A * | 2/2000 | Finkelstein et al. | 715/803 |
| 6,108,799 | A | 8/2000 | Boulay et al. | |
| 6,211,874 | B1 * | 4/2001 | Himmel et al. | 715/781 |
| 6,324,552 | B1 * | 11/2001 | Chang et al. | 715/501.1 |
| 6,629,138 | B1 * | 9/2003 | Lambert et al. | 709/224 |
| 6,778,194 | B1 * | 8/2004 | Jones | 715/808 |
| 2003/0005044 | A1 * | 1/2003 | Miller et al. | 709/203 |
| 2004/0165007 | A1 * | 8/2004 | Shafron | 345/781 |

OTHER PUBLICATIONS

F-Group Software, http://fgroupsoft.com/lecount/index.html, Version History at: http://www.fgroupsoft.com/lecount/History.html.*
ShiftHEAD—All Thumbs, 3 pages, wysiwyg://44/http://www.shifthead.com/software/all_thunbs/default.htm.
AlTech:Block annoying pop-up and . . . ver monitoring software A 1 Monitor! 8 pages, wysiwyg://63/http://www.altech.com/.
BooHoo's Help & Hint's & Tip's Page, 8 pages, http://software.xfx.net/~bruce/.
HistoryKill-Protect your Privacy onthe Internet for FREE! 3 pages, http://www.historykill.com/index.asp?filename=144.
GuardWall, Inc.—Guard-IE Privacy . . . rivacy Software, Personal Firewall, 5 pages, http://www.failsafetechnologies.com /English/GuardIE/index.asp.

(Continued)

*Primary Examiner*—Tadesse Hailu
*Assistant Examiner*—Alvin H Tan
(74) *Attorney, Agent, or Firm*—Marilyn Smith Dawkins; Amy J. Pattillo

(57) ABSTRACT

A system, method, and program controls the occurrence of unsolicited browser windows by enabling a user to specify a maximum depth of a window that can be opened. Before opening a new window, the browser determines the window depth in relation to the specified depth. If the new window to be opened has a given depth in relation to the specified setting which allows the new window to be opened, the window will be opened. If the new window to be opened has a given depth in relation to the specified setting which does not allow the new window to be opened, the window will not be opened. Furthermore, the browser prevents a new window from being opened from a current window if the current window is being closed.

14 Claims, 3 Drawing Sheets

OTHER PUBLICATIONS

Details for UltiMark—Powerful B0 . . . igation features to most browsers! 8 pages, http://www.ultimark.com/details.htm.

xFX JumpStart: PopUp Killer: Product Description, 17 pages, http://software.xfx.net/utilities/popupkiller/.

Popup Killer—CNETAsia, 2 pages, wysiwyg://50/http://asia.cnet.com/ . . . swinfo/0,39000587,38019896s,00.htm.

PopUp Killer—CNETAsia, 2 pages, wysiwyg://45/http://asia.cnet.com/ . . . swinfo/0,39000587,39006691s00.htm.

AdsGone Popup Killer—CNETAsia, 2 pages, wysiwyg://40/http://asia.cnet.com/ . . . swinfo/0,39000587,39005263s00.htm.

Panicware.com—Pop-Up Stopper Pro . . . p-Up Killer to stop web popup ads!, 2 pages, http://www.panicware.com/product_popupstopperpro.html.

Popup Ad Filter—Stop PopUp Windows, 4 pages, http://www.meaya.com/.

PopupDummy!—CNETAsia, 2 pages, wysiwyg://54http://asia.cnet.com/ . . . swinfo/0,39000587,38015372s,00.htm.

U.S. Appl. No. 09/973,158, Method, Apparatus and Computer Program Product For Eliminating Unnecessary Dialog Box Pop-Ups, 15 pages, filed Oct. 9, 2001.

U.S. Appl. No. 09/704,596,Multidimensional Browser Visual History Thread Viewer, 45 pages, filed Nov. 2, 2000.

U.S. Appl. No. 09/657,120, Method and System for Previewing Visual History Sessions, 37 pages, filed Sep. 7, 2000.

* cited by examiner

LIMITING UNSOLICITED BROWSER WINDOWS

BACKGROUND OF THE INVENTION

1. Field of the Invention

This invention relates to displaying information through a browser window at a client computer system connected to a network, and more specifically to limiting the number of unsolicited browser windows that can be generated on the client computer system.

2. Description of the Related Art

As computational devices continue to proliferate throughout the world, there also continues to be an increase in the use of networks connecting these devices. Computational devices include large mainframe computers, workstations, personal computers, laptops and other portable devices including wireless telephones, personal digital assistants, automobile-based computers, etc. Such portable computational devices are also referred to as "pervasive" devices. The term "computer" or "computational device", as used herein, may refer to any of such device which contains a processor and some type of memory.

The computational networks may be connected in any type of network including the Internet, an intranet, a local area network (LAN) or a wide area network (WAN). The networks connecting computational devices may be "wired" networks, formed using lines such as copper wire or fiber optic cable, wireless networks employing earth and/or satellite-based wireless transmission links, or combinations of wired and wireless network portions. Many such networks may be organized using a client/server architecture, in which "server" computational devices manage resources, such as files, peripheral devices, or processing power, which may be requested by "client" computational devices. "Proxy servers" can act on behalf of other machines, such as either clients or servers.

A widely used network is the Internet. The Internet, initially referred to as a collection of "interconnected networks", is a set of computer networks, possibly dissimilar, joined together by means of gateways that handle data transfer and the conversion of messages from the sending network to the protocols used by the receiving network. When capitalized, the term "Internet" refers to the collection of networks and gateways that use the TCP/IP suite or protocols.

Currently, the most commonly employed method of transferring data over the Internet is to employ the World Wide Web environment, referred to herein as "the Web". Other Internet resources exist for transferring information, such as File Transfer Protocol (FTP) and Gopher, but have not achieved the popularity of the Web. In the Web environment, servers and clients effect data transfer using the Hypertext Transfer Protocol (HTTP), a known protocol for handling the transfer of various data files (e.g., text, still graphic images, audio, motion video, etc.).

A Web browser is a software program running at a client computer system that displays Web pages from the Internet. The Web browser displays the information by interpreting the markup language (e.g., Hypertext Markup Language, HTML; Wireless Markup Language, WML; Extended Markup Language, XML; Standard Generalized Markup Language, SGML; etc.) used to build home pages on the Web. The coding in a markup language file tells the browser how to display the text, graphics, links and multimedia files on the home page. The Web browser also interprets tags within the Web page document as links to other Web sites, or to Web resources, such as graphics, multimedia files, news groups, or files to download.

Sometimes these links to other Web sites automatically produce advertisements that appear on the user's display by telling the browser to open another window to show the advertisement content. These advertisements appear to automatically "pop-up" in separate windows on the user's display screen. It is not uncommon for one advertising window to contain links to other advertising content such that a succession of browser windows are being generated, i.e., "popping up". This rampant opening of additional windows either in front of or behind the current window is referred to as a "popup storm" or "window storm." In extreme cases, these windows can make it difficult, if not impossible, to gain access to the information requested in the only window actually requested by the user. Needless to say, having windows automatically pop-up can be annoying to users.

In response to the use of "pop-up" windows by advertisers, "pop-up" killer applications are currently available on the market. These applications can notice when a browser window is to be opened. Some of the "pop-up" killer applications can prevent all browser windows from opening unless a specific key is pressed down by the user. Other "pop-up" killer applications can prevent all browser windows from opening after a certain number of browser windows have previously been opened. Once the number of opened windows exceeds a certain number, subsequent windows are killed. Other "pop-up" killer applications check for size, content, a specific URL, or a window name of the browser window to determine whether or not the "pop-up" window should be killed.

A problem with currently available "pop-up killer" applications that limit the number of windows from opening is that the user may indeed need to open multiple windows. In some "pop-up killer" applications, a user cannot have more than the predetermined number of browser windows opened at a given time even though the user may have intended to separately open them.

Another technique that advertisers tend to use that annoys, rather than informs, the user is the technique of creating new windows through "On Exit" functionality of a browser. For example, when the user attempts to close the browser, the actions taken when closing the current window cause the creation of another window, thereby spawning another pop-up storm.

SUMMARY OF THE INVENTION

It is therefore an object of the invention to limit the number of pop-up windows that can be automatically generated while still allowing the user to open as many windows as needed.

It is therefore a further object to provide a browser option that prohibits the opening of additional windows by any window that is currently closing.

Preferred embodiments of the system, method, and program of the present invention provide an enhancement to a browser, either in the browser itself or via a browser plugin, to kill or prevent pop-up windows by enabling a maximum window depth within a new browser invocation to be specified. The browser does not open any subsequent windows from a given window if the subsequent window would have a window depth greater than the specified maximum depth; or in other words, if the given window already has the specified maximum window depth. In an alternative embodiment, a browser window being opened is killed if it determines that its depth exceeds the specified maximum depth. Window depth refers to windows created by a previous window. If a main window was not created by a previous window; that is, the window was initiated by the operating system or other action outside of a browser, then that main window would have a window depth of zero (0). If a browser opens a new window from a previous window, the new window has at least a window depth of one (1). The window depth value is the number of the in-line succession of windows opened from a given main window of depth zero (0).

Furthermore, a maximum closing window depth can be specified that limits the depth level for which windows can be opened, if any, from a previous window that is being closed. In a preferred embodiment, the maximum window depth at closing is specified to be zero (0) such that no windows can be opened from a window that is being closed.

More specifically, each time there is a new invocation of the browser (e.g., by the operating system and not by the browser), there is a new depth zero (0) for that new invocation. Using the default values of a preferred embodiment, where the default value is a value other than zero (0), the browser would allow a user to open as many windows having a window depth value of one (1) as needed from a current depth zero (0) window. However, if a subsequent window having window depth value of (1) is opened by a user, the enhanced browser of a preferred embodiment can prevent the user opened subsequent window from automatically opening other windows if the maximum window depth value was set to a value of (1). The user can specify through the window depth preference that the user does not want subsequent windows from a window having the specified depth to be able to pop-up additional windows. The present invention is not concerned with the number of windows, but rather with the depth of the windows. That is, how many times did a window generate a new window which generated a window, etc. This is a different approach than arbitrarily specifying that only a certain number of windows can be opened, as is done by other "pop-up" killer applications.

The browser that is getting invoked during a subsequent invocation knows the depth because the browser is told the depth level of the previous browser invocation. The depth level is state information that is passed down from one browser invocation to the next. The browser itself keeps track of the depth level parameter. When a window is opened, these parameters are passed to the program that is being opened. A value in persistent storage, e.g., the operating system registry, is set to indicate the maximum browser depth that is allowed. The browser queries the value and determines if the browser is too deep. If so, the browser can terminate itself. In other embodiments, the browser window at the specified maximum depth that is doing the invoking will know not to invoke anything deeper.

The browser itself keeps track of the depth level. For example, if the operating system invokes the browser, the browser knows that the browser is at depth zero. If the browser invokes a next invocation of the browser, the first browser invocation adds a value of one (1) to its depth and passes this on to the next invocation of the browser as the next browser's depth and stores the value in memory local to that browser window instance. The browser then checks the persistent storage for the specified maximum depth level before opening a window at the next depth level. The browser can then make the decision of opening or not opening. In alternative embodiments, the browser could check the depth level after opening a window and determine whether or not to kill the window just opened.

As such, preferred embodiments of the invention prevent windows from popping up from windows that are currently being displayed without limiting the number of currently displayed windows that the user desires to have.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION OF THE PREFERRED EMBODIMENTS

In the following description, reference is made to the accompanying drawings which form a part hereof, and which illustrate several embodiments of the present invention. It is understood that other embodiments may be utilized and structural and operational changes may be made without departing from the scope of the present invention.

The present invention is carried out between at least two computers such as between a server and a client computing system. The client and server systems may be any one of a variety of systems, including a variety of computing systems and electronic devices under a number of different operating systems. In one embodiment of the present invention, the client computing system is a portable computing system such as a notebook computer, a palmtop computer, a personal digital assistant, a telephone or other electronic computing system that may also incorporate communications features that provide for telephony, enhanced telephony, messaging and information services. However, the client computing system, as well as the server system, may also be, for example, a desktop computer, a network computer, a midrange computer, a server system or a mainframe computer. Therefore, in general, the present invention is preferably executed in a computer system that performs computing tasks such as manipulating data in storage that is accessible to the computer system. In addition, the computer system preferably includes at least one output device and at least one input device.

Figure 1:
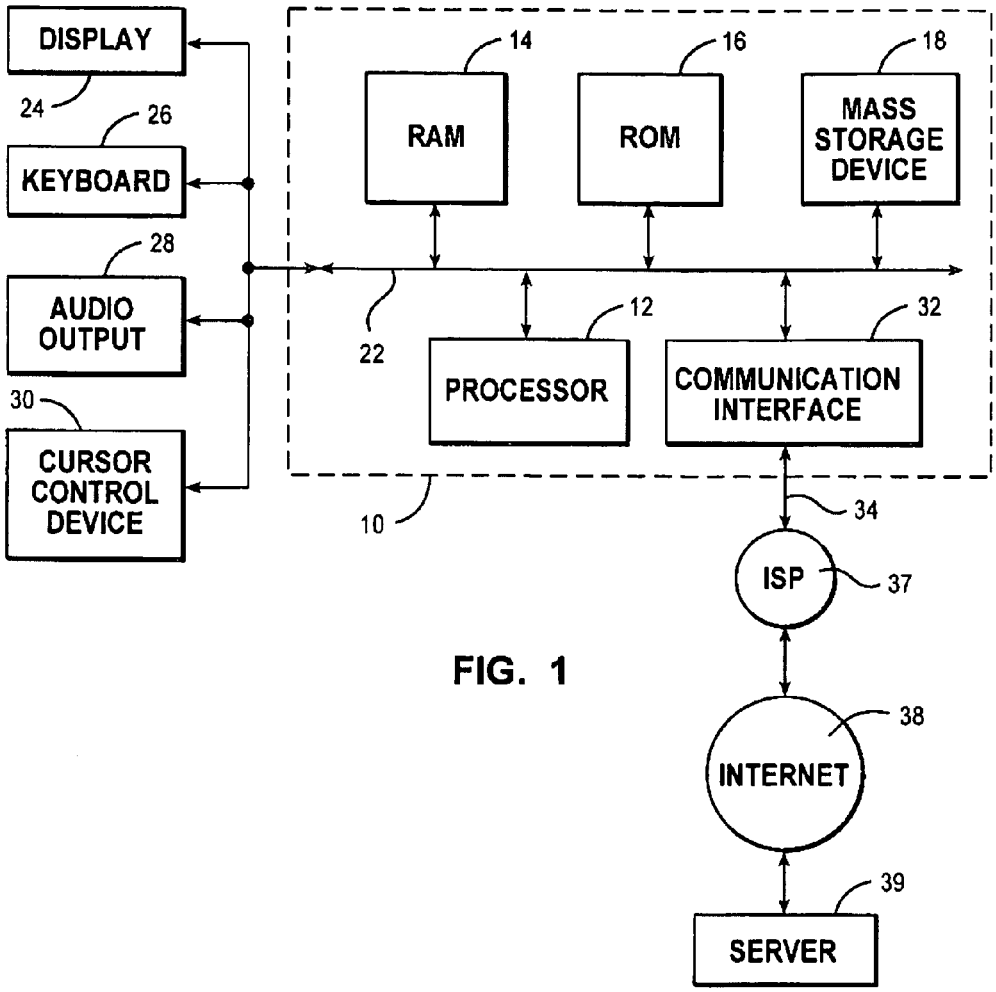
FIG. 1 depicts one embodiment of a computer system with which the method, system, and program of the present invention may be advantageously utilized.

Referring now to the drawings, and in particular to FIG. 1, there is depicted one embodiment of a computer system with which the method, system, and program of the present invention may be advantageously utilized. Computer system 10 comprises a bus 22 or other communication device for communicating information within computer system 10, and at least one processing device such as processor 12, coupled to bus 22 for processing information. Bus 22 preferably includes low-latency and high-latency paths that are connected by bridges and controlled within computer system 10 by multiple bus controllers.

Processor 12 may be a general-purpose processor such as IBM's PowerPC™ processor that, during normal operation, processes data under the control of operating system and application software stored in a dynamic storage device such as a random access memory (RAM) 14 and a static storage device such as Read Only Memory (ROM) 16. The operating system preferably provides a graphical user interface (GUI) to the user. One application may include a client application (e.g., a browser) capable of transmitting and receiving data to and from a server application within a server within a data processing system network. Client system 10 may execute one or more user applications, either within browser application or apart from browser application. Such user application(s) include the functionality describe below to limit the number of unsolicited windows from popping up. As such, in a preferred embodiment, application software contains machine executable instructions that when executed on processor 12 carry out the operations depicted in the figures described herein. Alternatively, embodiments of the present invention might be performed by specific hardware components that contain hardwire logic for performing the functions, or by any combination of programmed computer components and custom hardware components.

Further, multiple peripheral components may be added to computer system 10. For example, a display 24 is also attached to bus 22 for providing visual, tactile or other graphical representation formats. Audio output through a speaker or other audio projection device may be controlled by audio output device 28 attached to bus 22. A keyboard 26 and cursor control device 30, such as a mouse, track ball, or cursor direction keys, are coupled to bus 22 as interfaces for user inputs to computer system 10. It should be understood that keyboard 26 and cursor control device 30 are examples of multiple types of input devices that may be utilized in the present invention. In alternate embodiments of the present invention, additional input and output peripheral components may be added.

The present invention may be provided as a computer program product, included on a machine-readable medium having stored thereon the machine executable instructions used to program computer system 10 to perform a process according to the present invention. The term "machine-readable-medium" as used herein includes any medium that participates in providing instructions to processor 12 or other components of computer system 10 for execution. Such a medium may take many forms including, but not limited to, nonvolatile media, volatile media, and transmission media. Common forms of nonvolatile media include, for example, a floppy disk, a flexible disk, a hard disk, magnetic tape or any other magnetic medium, a compact disc ROM (CD-ROM), a digital video disc-ROM (DVD-ROM) or any other optical medium, punch cards or any other physical medium with patterns of holes, a programmable ROM (PROM), an erasable PROM (EPROM), electrically EPROM (EEPROM), a flash memory, any other memory chip or cartridge, or any other medium from which computer system 10 can read and which is suitable for storing instructions. In the present embodiment, an example of nonvolatile media is storage device 18. Volatile media includes dynamic memory such as RAM 14. Transmission media includes coaxial cables, copper wire or fiber optics, including the wires that comprise bus 22. Transmission media can also take the form of acoustic or light waves, such as those generated during radio wave or infrared data communications.

Moreover, the present invention may be downloaded as a computer program product, wherein the program instructions may be transferred from a remote computer such as server 39 to requesting computer system 10 by way of data signals embodied in a carrier wave or other propagation medium via a network link 34 (e.g., a modem or network connection) to a communications interface 32 coupled to bus 22. Communications interface 32 provides a two-way data communications coupling to network link 34 that may be connected, for example, to a local area network (LAN), wide are network (WAN), or as depicted herein, directly to an Internet Service Provider (ISP) 37. In particular, network link 34 may provide wired and/or wireless network communications to one or more networks.

ISP 37 in turn provides data communication services through the Internet 38 or other network. Internet 38 may refer to the worldwide collection of networks and gateways that use a particular protocol, such as Transmission Control Protocol (TCP) and Internet Protocol (IP), to communicate with one another. ISP 37 and Internet 38 both use electrical, electromagnetic, or optical signals that carry digital or analog data streams. The signals through the various networks and the signals on network link 34 and through communications interface 32, which carry the digital or analog data to and from computer system 10, are exemplary forms of carrier waves transporting the information.

A data processing network may include one or more servers which are accessible as part of the Internet or other network, and one or more clients which may access servers. Content may be accessed using any of a variety of messaging system protocols including Hypertext Transfer Protocol (HTTP), File Transfer Protocol (FTP), Network News Transfer Protocol (NNTP), Internet Mail Access Protocol (IMAP) or Post Office Protocol (POP), etc. In a preferred embodiment, communications between data processing systems occur over the Internet and conform to the Hypertext Transfer Protocol (HTTP) in accordance with the known art.

Figure 4:
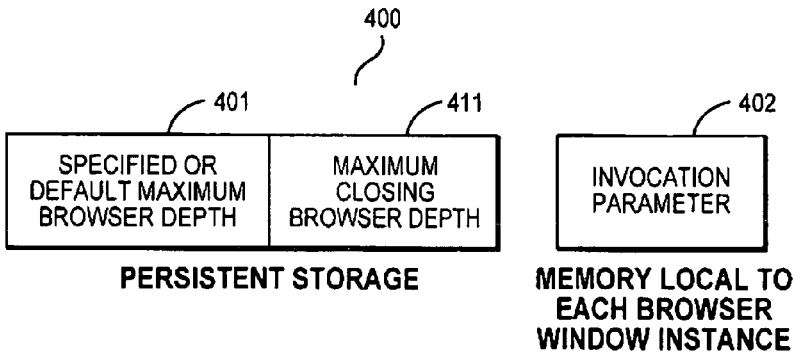
FIG. 4 illustrates exemplary data structures utilized by the browser in carrying out the process and program of an embodiment of the invention.
Figure 2:
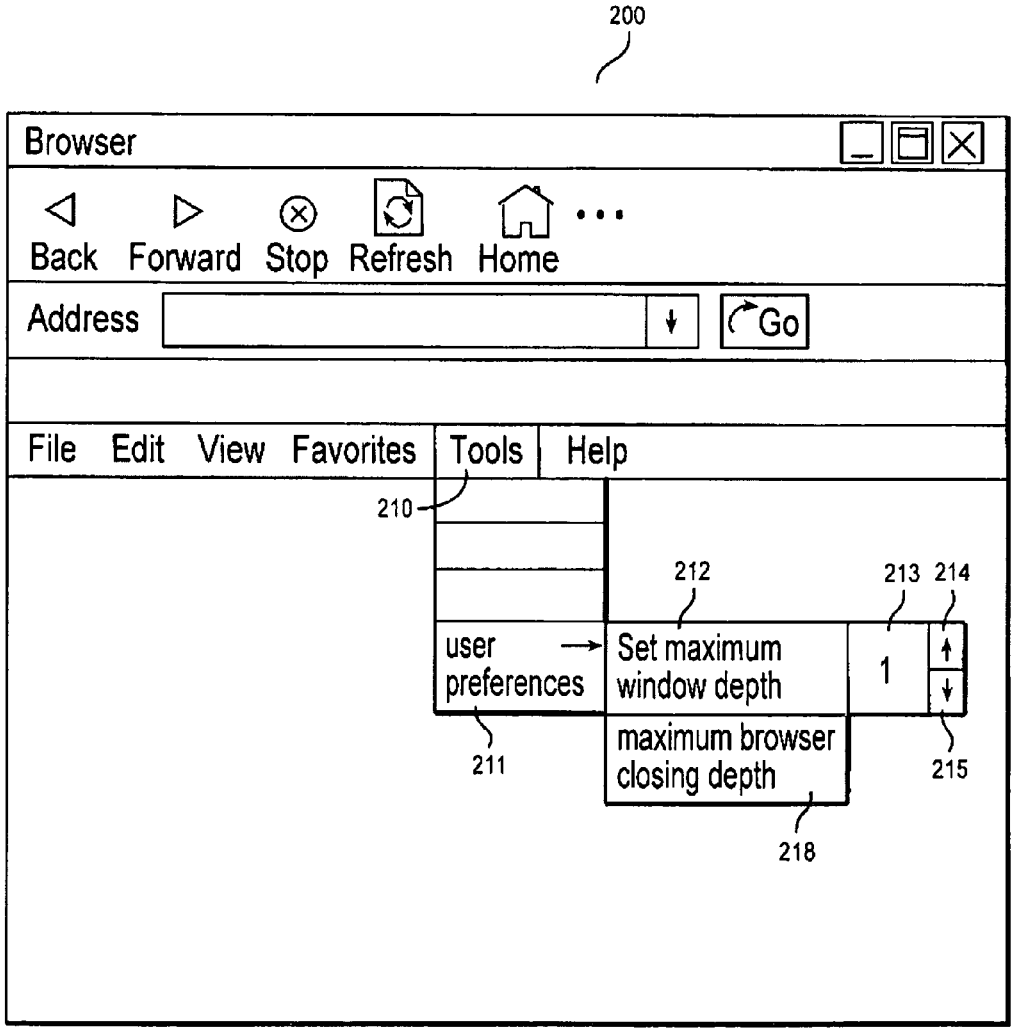
FIG. 2 illustrates a browser user interface for specifying an allowable window depth.
Figure 3:
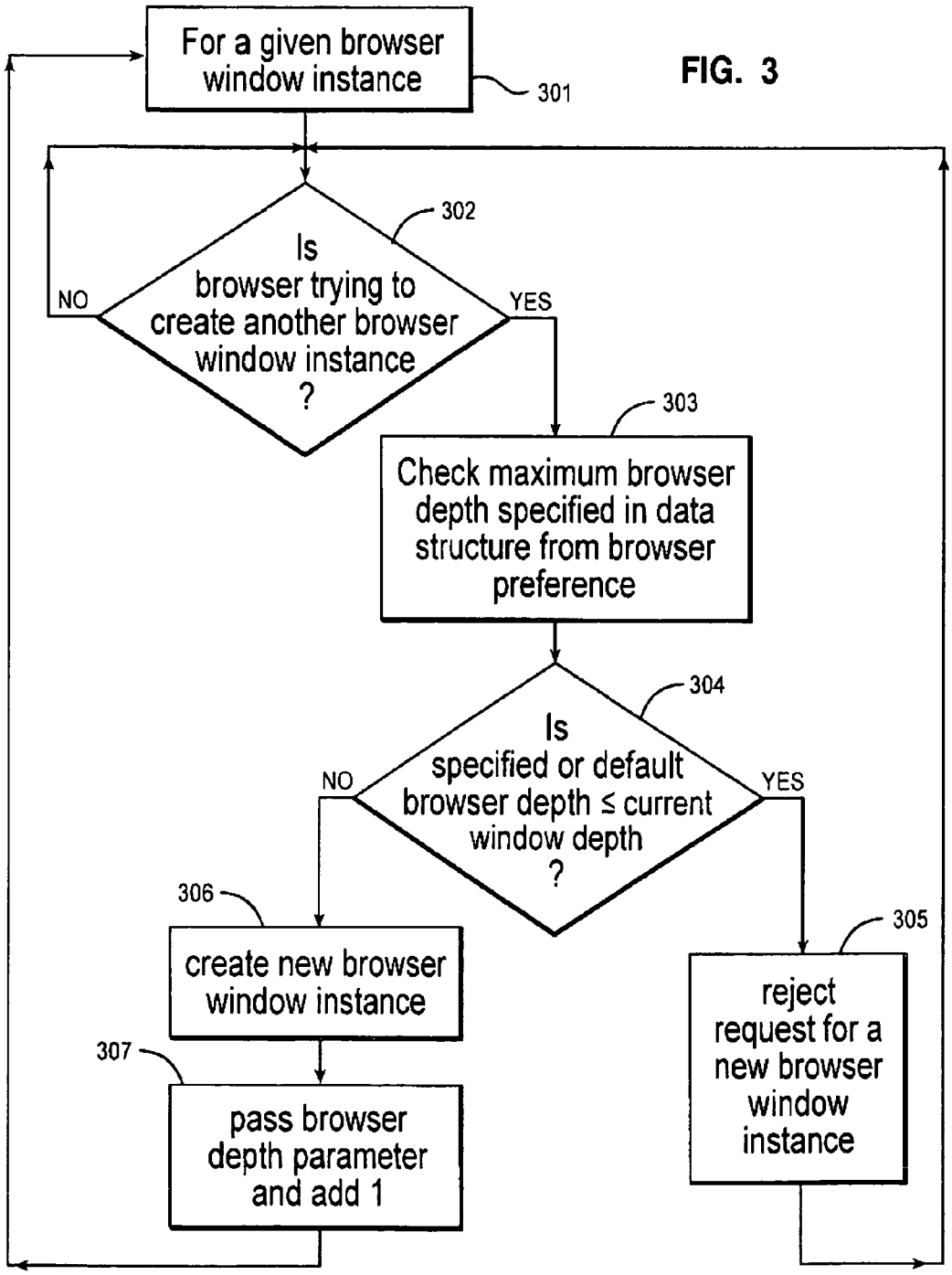
FIG. 3 is a flow diagram and logic utilized in an embodiment of the invention.

With reference to FIGS. 2, 3, and 4, a preferred embodiment of utilizing browser depth checking for limiting the number of unsolicited browser windows is described. FIG. 2 illustrates a browser user interface for specifying an allowable window depth. FIG. 3 is a flow diagram and logic of browser depth checking utilized in an embodiment of the invention. FIG. 4 illustrates an example of a data structure 400 utilized by the browser in carrying out the process and program of an embodiment of the invention.

FIG. 2 illustrates an example of a browser user interface 200 having user preferences 211 as a selection under "Tools" 210 selectable button which enables a maximum browser window depth 212 to be specified by a user by inputting a value in a value field 213 and/or by altering a current value by arrows 214, 215. In some embodiments, the user can input any symbol other than a numerical value to specify that the depth is unlimited. Other embodiments enable the user to "turn off" this preference or feature. In yet other embodiments, if not specified, the browser will default to either an unlimited number of depths, or to some very large number of depths, e.g., ten or twenty, etc.

The user specified value, or default value, will be stored in data structure 400 (FIG. 4) as the specified or default browser depth, 401. The invocation parameter 402 which is the depth level defined for each browser window instance is stored in memory local to each browser window instance. A browser window instance can be either a separate browser process or that portion of a single browser process that manages a single child window. The value of the parameter 402 is the current browser depth. The default value of this parameter is zero, indicating that the browser window instance has not been recursively invoked.

Referring to FIG. 3, for each given browser window instance 301, it is determined if another browser window instance is trying to be opened, 302. If not, the process continues until one is. Each time the browser window instance attempts to create another browser window instance, the browser window instance first checks the maximum browser depth specified in the data structure from the browser preferences, 303. If the maximum browser depth is less than or equal to the browser depth that was specified when the current browser window instance was invoked, i.e., current window (browser) depth, 304, the request for a new browser window instance will be rejected, 305. Otherwise, a new browser window instance will be created, 306; and it will be passed a browser depth parameter, i.e., invocation parameter 402 (FIG. 4) that is one greater than the current browser depth, 307. The process continues for that new browser window instance back to step 301, as well as for any other current browser instances, i.e., the parent browser instance of the new browser instance. It should be noted that the parent browser instance still retains its same invocation parameter. It should be noted that other embodiments may have variations in the value of the browser depth being stored, that is, whether a maximum allowed browser depth is stored or a value of the first depth where no further windows will be opened. Likewise, various embodiments will vary in the comparison being made since the comparison will depend on the meaning of the value that is being specified and stored. For example, a comparison with the specified depth value may be made against the depth of the current window that is trying to generate a new window; or the comparison with the specified value may be made against the depth that the new window would have if generated.

In general, by defining a maximum browser depth 401 (FIG. 4) of zero, the browser will never open any additional browser windows, since the maximum depth will already have been reached. This is similar to suppression of all popup windows that is offered by other "popup killers". However, by defining a maximum browser depth of one, the initial browser window instance will be able to open an unlimited number of new browser window instances, all with a browser depth of one. However, none of those browser window instances will be able to create additional browser window instances. Unlike other "popup killers", this allows the user to view pages which open new windows for every link, but still suppresses any additional windows that those browser window instances would create.

In a further embodiment of the invention a user can also specify a separate maximum browser closing depth 218 (FIG. 2) in the browser preferences. This eliminates the flurry of windows that are often created when closing browser windows. This uses the same algorithm as described with respect to FIG. 3 above, and the same invocation parameter 402 (FIG. 4) defined above, but utilizes the maximum closing browser depth 411 (FIG. 4) for the check instead of the maximum browser depth 401 (FIG. 4). It should be noted that maximum closing browser depth 411 (FIG. 4) is not required in data structure 400 for embodiments previously discussed that merely specify the maximum window depth. For this embodiment, however, the maximum browser closing depth 411 is utilized and will default to zero, since the action of closing a window usually implies that the user wants to reduce the number of windows rather than increase it. In a further preferred embodiment, the maximum browser closing depth 218 (FIG. 2) is implemented as a check box which will enable or disable all browser window instances created when closing the current browser window instance, where enable sets the maximum browser closing depth to a very large number, and disable sets the value to zero.

The preferred embodiments may be implemented as a method, system, or article of manufacture using standard programming and/or engineering techniques to produce software, firmware, hardware, or any combination thereof. The term "article of manufacture" (or alternatively, "computer program product") as used herein is intended to encompass data, instructions, program code, and/or one or more computer programs, and/or data files accessible from one or more computer usable devices, carriers, or media. Examples of computer usable mediums include, but are not limited to: nonvolatile, hard-coded type mediums such as CD-ROMs, DVDs, read only memories (ROMs) or erasable, electrically programmable read only memories (EEPROMs), recordable type mediums such as floppy disks, hard disk drives and CD-RW and DVD-RW disks, and transmission type mediums such as digital and analog communication links, or any signal bearing media. As such, the functionality of the above described embodiments of the invention can be implemented in hardware in a computer system and/or in software executable in a processor, namely, as a set of instructions (program code) in a code module resident in the random access memory of the computer. Until required by the computer, the set of instructions may be stored in another computer memory, for example, in a hard disk drive, or in a removable memory such as an optical disk (for use in a CD ROM) or a floppy disk (for eventual use in a floppy disk drive), or downloaded via the Internet or other computer network, as discussed above. The present invention applies equally regardless of the particular type of signal-bearing media utilized.

The foregoing description of the preferred embodiments of the invention has been presented for the purposes of illustration and description. It is not intended to be exhaustive or to limit the invention to the precise form disclosed. Many modifications and variations are possible in light of the above teaching. For example, although preferred embodiments of the invention have been described in terms of the Internet, other network environments including but not limited to wide area networks, intranets, and dial up connectivity systems using any network protocol that provides basic data transfer mechanisms may be used.

It is intended that the scope of the invention be limited not by this detailed description, but rather by the claims appended hereto. The above specification, examples and data provide a complete description of the manufacture and use of the system, method, and article of manufacture, i.e., computer program product, of the invention. Since many embodiments of the invention can be made without departing from the spirit and scope of the invention, the invention resides in the claims hereinafter appended.

Having thus described the invention, what we claim as new and desire to secure by Letters Patent is set forth in the following claims.

The invention claimed is:

1. A method for controlling browser windows, comprising:

enabling a first specified setting of a depth of a browser window and a second specified setting of a maximum closing depth;

responsive to detecting a request for opening a new separate browser window from a current browser window, detecting whether the current browser window is being closed;

if the current browser window is being closed, only opening the new separate browser window if the new separate browser window has a given depth in relation to the second specified setting which allows the new separate browser window to be opened; and if the current browser window remains open, only opening the new separate browser window if the new separate browser window has a given depth in relation to the first specified setting which allows the new window to be opened.

2. The method of claim 1, further comprising:

detecting said given depth in relation to the second specified setting by comparing a depth of said current browser window with said second specified setting and only allowing opening of the new separate browser window if the depth of the current browser window is less than the second specified setting.

3. The method of claim 1 further comprising detecting said given depth of said new separate browser window from a particular depth of said current browser window increased by one.

4. A method for controlling browser windows, comprising:

enabling a first specified setting of a maximum depth of a browser window capable of being generated from a previously generated given browser window and a second specified setting of a maximum closing depth;

determining a current depth of a current opened window;

responsive to detecting a request for opening a new separate window from the current opened window, detecting whether the current opened window is being closed;

if the current opened window is being closed, only opening the new separate window if the determined depth of the current opened window is less than the second specified setting; and if the current opened window remains open, only opening the new separate window from the current opened window if the determined depth of the current opened window is less than the first specified setting.

5. The method of claim 4 further comprising:

if the determined depth of the current opened window is less than the first specified setting and the new separate window is opened, repeating the steps of determining and only opening wherein the opened new separate window becomes the current opened window.

6. A computer program product on a tangible computer usable medium having computer readable program code means for controlling browser windows, comprising:

instruction means for enabling a first specified setting of a depth of a browser window and a second specified setting of a maximum closing depth;

instruction means for detecting whether a current browser window is being closed, responsive to detecting a request for opening a new separate browser window from the current browser window, instruction means for if the current browser window is being closed, only opening the new separate browser window if the new separate browser window has a given depth in relation to the second specified setting which allows the new separate browser window to be opened; and instruction means for if the current browser window remains open, only opening the new separate browser window if the new separate browser window has a given depth in relation to the first specified setting which allows the new window to be opened.

7. The computer program of claim 6 further comprising instruction means for detecting said given depth in relation to the second specified setting by comparing a depth of said current browser window with said second specified setting and only allowing opening of the new separate browser window if the depth of the current browser window is less than the second specified setting.

8. A computer program product on a tangible computer usable medium having computer readable program code means for controlling browser windows, comprising:

instruction means for enabling a first specified setting of a maximum depth of a browser window capable of being generated from a previously generated given browser window and a second specified setting of a maximum closing depth;

instruction means for determining a current depth of a current opened window;

instruction means for detecting whether the current opened window is being closed, responsive to detecting a request for opening a new separate window from the current opened window;

instruction means for if the current opened window is being closed, only opening the new separate window if the determined depth of the current opened window is less than the second specified setting; and instruction means for if the current opened window remains open, only opening the new separate window from the current opened window if the determined depth of the current opened window is less than the first specified setting.

9. A computer system having a browser program for controlling a display of pages retrieved over a network, comprising:

means for enabling a first specified setting of a depth of a browser window and a second specified setting of a maximum closing depth;

means, responsive to detecting a request for opening a new separate browser window from a current browser window, for detecting whether the current browser window is being closed;

means, if the current browser window is being closed, for only opening the new separate browser window if the new separate browser window has a given depth in relation to the second specified setting which allows the new separate browser window to be opened; and means, if the current browser window remains open, for only opening the new separate browser window if the new separate browser window has a given depth in relation to the first specified setting which allows the new window to be opened.

10. The computer system of claim 9, further comprising means for detecting said given depth in relation to the second specified setting by comparing a depth of said current browser window with said second specified setting and only allowing opening of the new separate browser window if the depth of the current browser window is less than the second specified setting.

11. The computer system of claim 10 further comprising means for detecting said given depth of said new separate browser window from a particular depth of said current browser window increased by one.

12. A computer system having a browser program for controlling a display of pages retrieved over a network, comprising:

means for enabling a first specified setting of a maximum depth of a browser window capable of being generated from a previously generated given browser window and a second specified setting of a maximum closing depth;

means for determining a current depth of a current opened window;

means, responsive to detecting a request for opening a new separate window from the current opened window, for detecting whether the current opened window is being closed;

means, responsive to the current opened window is being closed, for only opening the new separate window if the determined depth of the current opened window is less than the second specified setting; and means, responsive to the current opened window remaining open, for only opening the new separate window from the current opened window if the determined depth of the current opened window is less than the first specified setting.

13. A computer system having a browser program for controlling a display of pages retrieved over a network, comprising:

a bus system;

a communication unit connected to the bus system;

a memory connected to the bus system, wherein the memory includes a set of instructions; and a processing unit connected to the bus system, wherein the processing system executes the set of instructions to enable a first specified setting of a depth of a browser window and a second specified setting of a maximum closing depth; to detect whether a current browser window is being closed when a request for opening a new separate browser window from the current browser window is received; responsive to detecting that the current browser window is being closed, to only open the new separate browser window if the new separate browser window has a given depth in relation to the second specified setting which allows the new separate window to be opened; and responsive to detecting that the current browser window remains open, only opening the new separate browser window if the new separate browser window has a given depth in relation to the first specified setting which allows the new window to be opened.

14. A method for controlling browser windows, comprising:

enabling a first specified setting of a maximum depth of a browser window and a second specified setting of a maximum closing depth;

tracking a depth level of a current window;

responsive to detecting a request for opening a new separate window from the current window, detecting whether the current window is being closed;

if the current browser window is being closed, only opening the new separate window if the tracked depth level of the current window is less than the second specified setting; and if the current browser window remains open, only opening the new separate window from the current window if the tracked depth level of the current window is less than the first specified setting.

* * * * *